US006145686A

United States Patent [19]

Stinson

[11] Patent Number: 6,145,686

[45] Date of Patent: Nov. 14, 2000

[54] FUME, FIRE, AND FLASH EXPLOSION CONTAINMENT APPARATUS USING A FABRIC ENCLOSURE

[76] Inventor: Brenda Stinson, 402 S. Main Street, Kellogg, Id. 83837

[21] Appl. No.: 08/898,717

[22] Filed: Jul. 22, 1997

[51] Int. Cl.[7] ..... B65D 25/20

[52] U.S. Cl. ..... 220/62.22; 220/88.1; 220/23.86; 220/495.06

[58] Field of Search ..... 220/9.4, 1.5, 23.83, 220/23.86, 23.87, 62.22, 694.1, 592.15, 88.1, 403, 460, 461, 408, 23.9, 495.06; 383/104, 110, 119; 428/36.1, 35.8

[56] References Cited

U.S. PATENT DOCUMENTS 1,727,530 9/1929 Washburn ..... 220/23.87
1,878,063 9/1932 Todd .
4,871,597 10/1989 Hobson .
5,472,279 12/1995 Lin ..... 383/110
5,506,043 4/1996 Lilani .
5,595,320 1/1997 Aghassipour ..... 383/110

*Primary Examiner*—Stephen Castellano
*Attorney, Agent, or Firm*—Craig M. Korfanta

[57] ABSTRACT

A system for carrying supplemental oxygen bottles on a passenger aircraft has an oxygen canister locker enclosed in a special high temperature resistant fabric enclosure to prevent the spread of fire and fumes. The fabric enclosure has a sealable opening therein to receive the oxygen canister locker and allow access to the contents of the locker. The fabric enclosure is lined with a metalized fabric liner which is heat resistant up to temperatures exceeding 1500° Fahrenheit. Additionally, the seams used to construct the bag as well as the construction techniques are such that fumes are inhibited from escaping the enclosure.

8 Claims, 5 Drawing Sheets

FUME, FIRE, AND FLASH EXPLOSION CONTAINMENT APPARATUS USING A FABRIC ENCLOSURE

BACKGROUND OF THE INVENTION

1. Technical Field

This invention generally relates to apparatus for containing fumes, fire and flash explosions. More particularly, this invention relates to a light weight fabric enclosure and enclosed locker for housing oxygen canisters on passenger aircraft to prevent the escape of fumes and fire should one or more of the oxygen canisters explode.

2. Background

Recent airline catastrophes have raised the possibility that toxic fumes emanating from a fire in an oxygen canister locker on a passenger aircraft contributed to deaths and/or crash of the aircraft. Reserve oxygen canisters or bottles are carried on passenger aircraft in a locker lined with a styrene liner configured to hold and cushion individual oxygen canisters. These canisters must be frequently replaced to ensure that fresh oxygen is available if necessary. Typically the canisters are replaced during the refueling of the aircraft and thus it must be accomplished quickly and efficiently. Hence, the standard practice is to store the canisters in on-board lockers which are easily accessible yet designed to withstand the explosive force generated should one of the oxygen canisters explode. However, these lockers do not provide a means for preventing any resulting fire or fumes from escaping. Therefore, it would be desirable to provide a fume and fire containment apparatus for the oxygen canisters which at least inhibits and/or prevents altogether the spread of fire and fumes and which does not inhibit the quick change out of fresh oxygen canisters.

SUMMARY OF THE INVENTION

Accordingly, the invention has an oxygen canister locker enclosed in a special high temperature resistant fabric enclosure. The fabric enclosure has a sealable opening therein to receive the oxygen canister locker and allow access to the contents of the locker. The fabric enclosure is lined with a metalized fabric liner which is heat resistant up to temperatures exceeding 1500° Fahrenheit. Additionally, the seams used to construct the bag as well as the construction techniques are such that fumes are inhibited from escaping the enclosure.

In one embodiment, the enclosure has an outer layer of Cordura nylon 1000 denier fabric to which an inner layer of tri-blend fabric is attached. The tri-blend fabric is a DUAL MIRROR aluminized knit fabric made from a blend of PBI (polyenzimidaxole fibers), KEVLAR (a spunlaced synthetic fiber fabric) and PFR (permanently flame-retardant) rayon fabric manufactured by Gentex Corp., Carbondale, Pa. The tri-blend fabric includes a first base layer of integral PFR rayon fabric, a second layer of PBI/KEVLAR knit fabric, a third layer of adhesive, a fourth layer of aluminum, a fifth layer of MYLAR, a strong, thin polyester film, and a sixth layer of aluminum.

The enclosure itself is, in this embodiment, a rectangular enclosure having a single back and top panel, wherein the top panel is releasably sealed to the top edges of the side and front panels via a high temperature hook and loop fastening mechanism, preferably NOMEX VELCRO (a fire resistant hook and loop fastener). The top edges of the side and front panels include top flange portions which extend partially over the top surface of an enclosed canister locker and provide an attachment surface for the top panel.

DETAILED DESCRIPTION OF THE INVENTION

Figure 1:
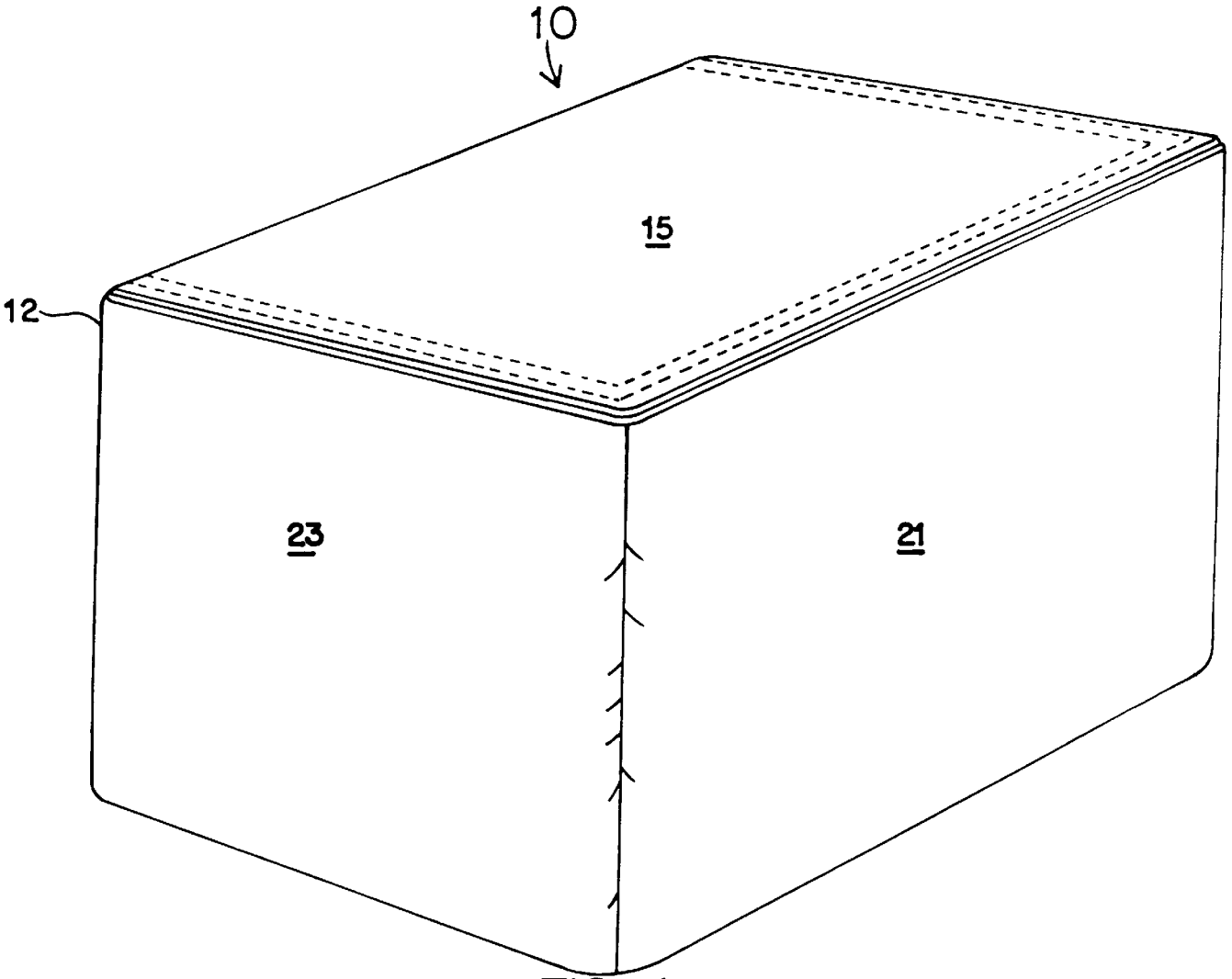
FIG. 1 is an isometric view of the fume, fire and flash explosion containment apparatus in accordance with the invention.
Figure 2:
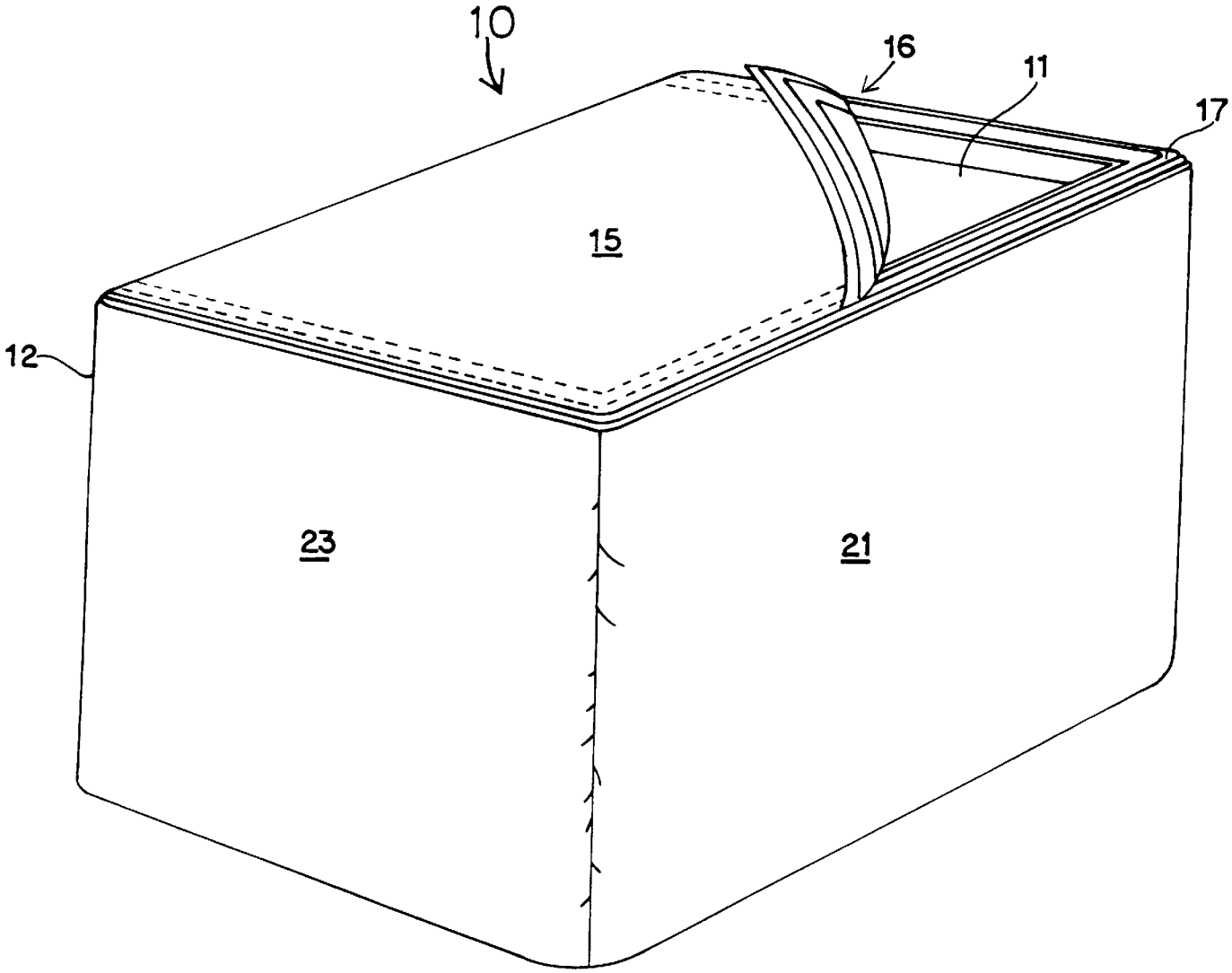
FIG. 2 is an isometric view of the fume, fire and flash explosion containment apparatus in accordance with the invention with the top panel or lid in a partially open position.
Figure 3:
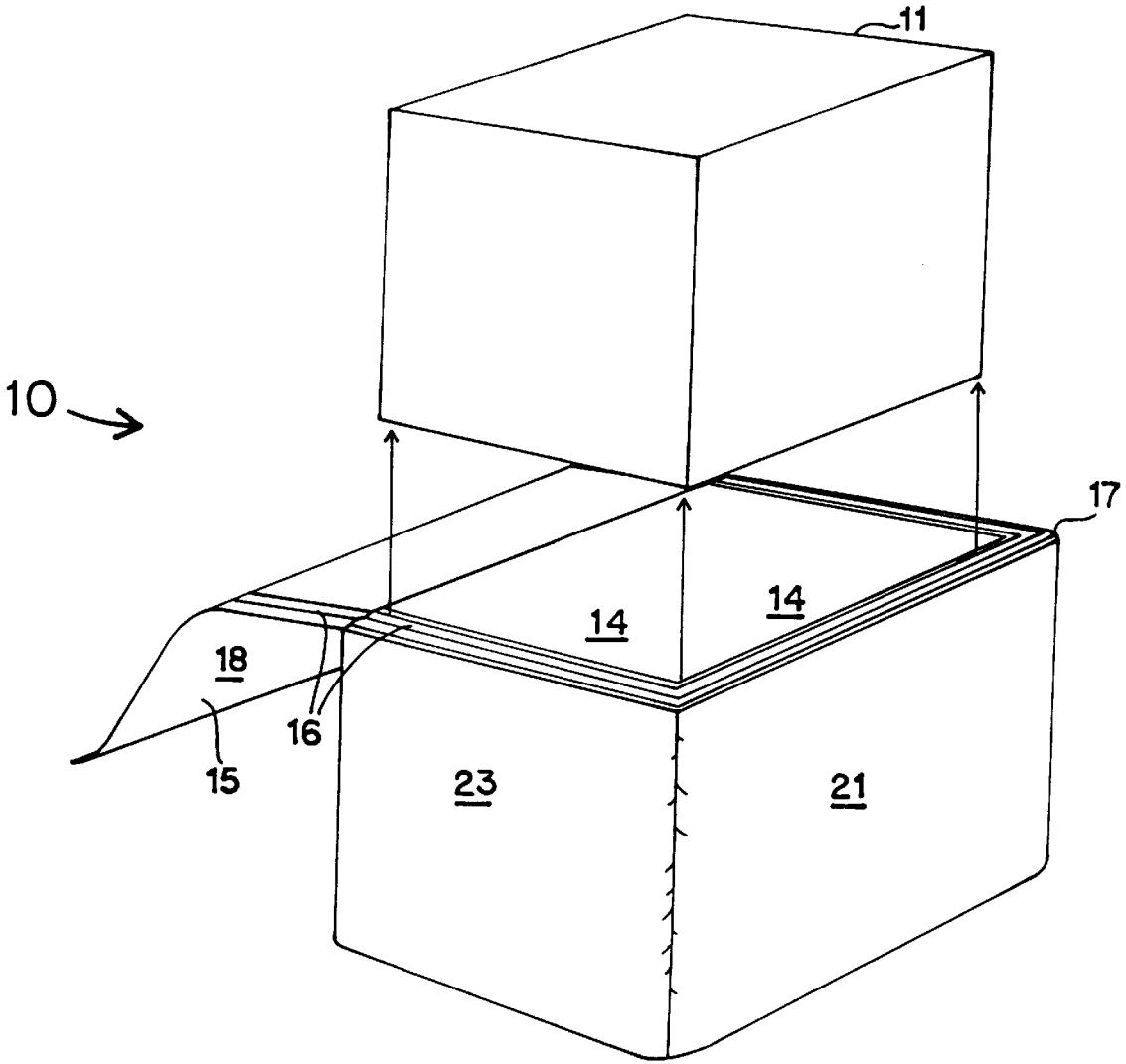
FIG. 3 is an exploded isometric view of the fume, fire and flash explosion containment apparatus in accordance with the invention illustrating how the canister locker is inserted into the fabric enclosure.
Figure 4:
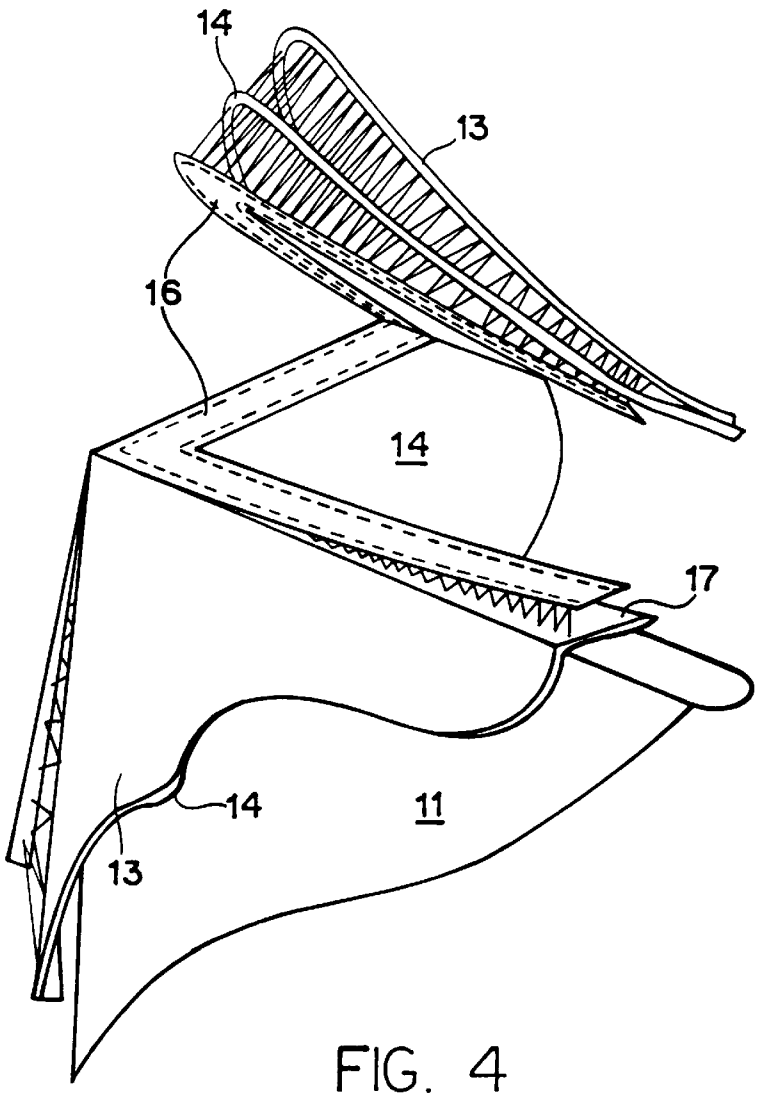
FIG. 4 is a combination detail and assembly isometric view of the fume, fire and flash explosion containment apparatus in accordance with the invention.

Referring now to the figures, a fume, fire and flash explosion containment apparatus according to the innovation is illustrated in detail and generally designated as 10 therein.

Fume, fire and flash containment apparatus 10 includes a rigid oxygen canister locker 11 contained within a fabric locker enclosure 12. Locker 11 is generally a rectangular box manufactured from a sturdy material such as metal and includes a hinged lid. Oxygen canisters or bottles are stored within locker 11 and are cushioned by styrene packing or the like.

Fabric locker enclosure 12 has an outer fabric enclosure 13 made from a durable fabric such as 1,000 denier CORDURA nylon fabric. An inner metalized fabric liner 14 is fixed within outer fabric enclosure 13 to present a heat reflective and resistant surface to the interior of fabric locker enclosure 12. In the preferred embodiment, inner fabric liner 14 is made of a tri-blend fabric which is a DUAL MIRROR aluminized knit fabric which in turn is made from a blend of PBI, KEVLAR and PFR rayon fabric manufactured by Gentex Corp., Carbondale, Pa. The tri-blend fabric includes a first base layer of integral PFR rayon fabric, a second layer of PBI/KEVLAR knit fabric, a third layer of adhesive, a fourth layer of aluminum, a fifth layer of MYLAR and a sixth layer of aluminum. This fabric exhibits excellent heat resistance as well as being lightweight and durable.

Fabric locker enclosure 12 includes a flap or lid 15 which is releasably sealable, via seal 16, to the main body of fabric locker enclosure 12 to complete the enclosure. Enclosure 12 is sized and shaped to fairly closely receive locker 11. A sealing flange 17 is formed along the top edges of front panel 21, right side panel 22 and left side panel 23, to provide a surface to which one half of seal 16 is affixed. Seal 16 is, in the preferred embodiment, a high temperature resistant hook and loop fastener sold under the brand name NOMEX VELCRO. The other half of seal 16 is affixed around the underside marginal front and side edges of lid 15.

Figure 5:
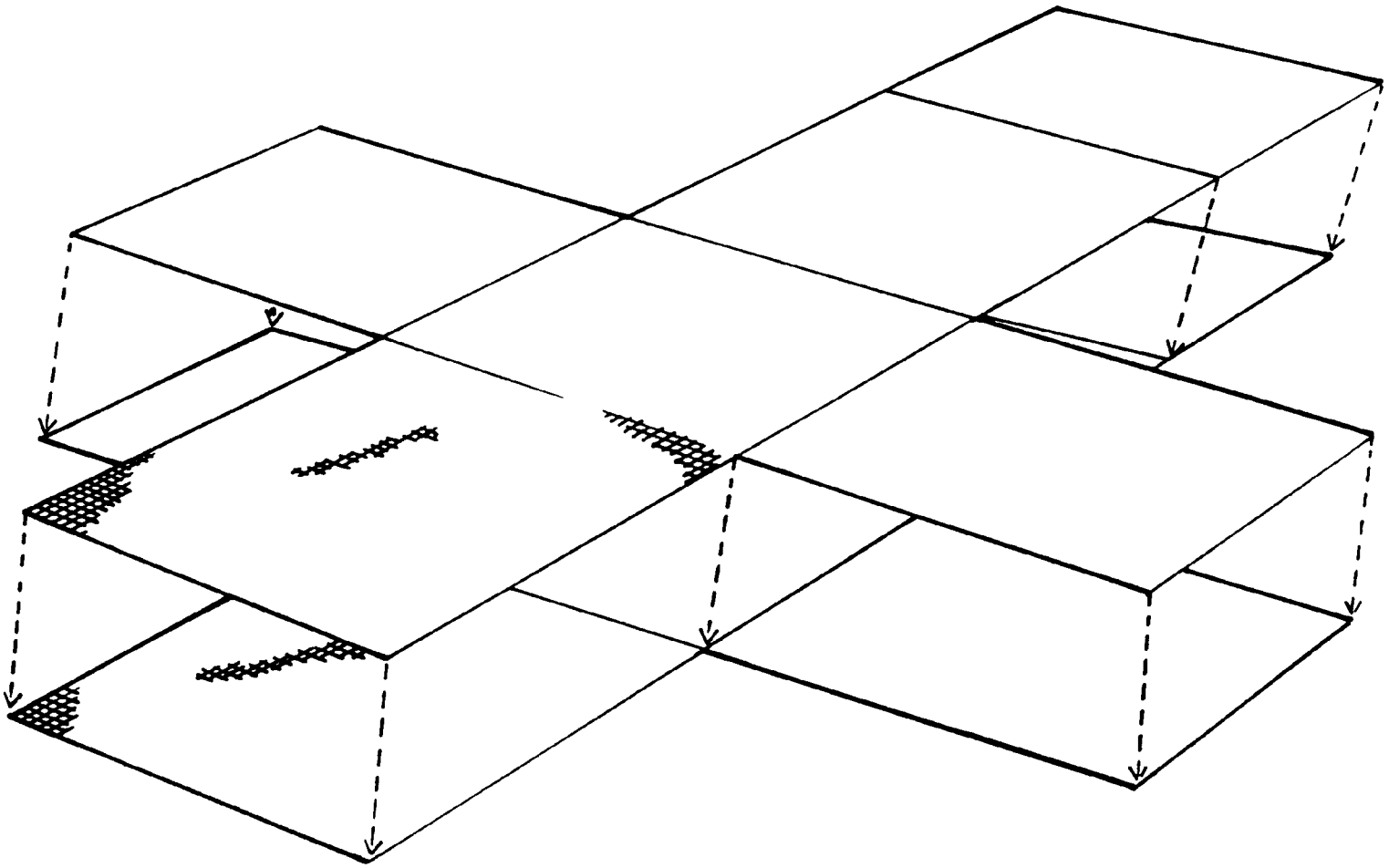
FIG. 5 is an assembly drawing of the fabric enclosure in accordance with the invention.

FIG. 5 illustrates the general pattern layout for the textile construction of fabric enclosure 12. The main compartment portions of both outer fabric enclosure 13 and inner aluminized fabric liner 14 are constructed first. Both these pieces are then turned inside out and the reflective surface of inner liner 14 is placed against the outer surface of outer fabric enclosure 13. Liner 14 is then joined with enclosure 13 at the top edges of front panel 21, right side panel 22 and left side panel 23, as well as along the right and left side edges of top panel 18. This assembly is then turned right side out through the open seam along the front edge of front panel 21. This open seam is then joined to complete the basic enclosure. The ends of flanges 17 along the top edges of front panel 21, right side panel 22 and left side panel 23 are joined together to complete sealing flange 17. Finally, the loop portion of the hook and loop fastener seal 16 is sewn around sealing flange 17 while the mating hook portion is sewn around the marginal edges of the underside of lid 15. Preferably, all seams and construction are accomplished using high temperature KEVLAR thread.

In use, locker 11 containing oxygen canisters is inserted into the interior of fabric locker enclosure 12 and lid 15 is sealed shut using seal 16. When it is desired to change the oxygen canisters, lid 15 is opened and the entire locker can be changed out, or the lid of the locker can be opened to access its contents.

While there is shown and described the preferred embodiment of the invention, it is to be distinctly understood that this invention is not limited thereto but may be variously embodied to practice within the scope of the following claims.

I claim:

1. An enclosure for a compressed gas canister locker which comprises:

an outer three dimensional fabric enclosure having a high temperature resistant sealable lid; and an inner high temperature resistant metalized fabric liner fixed within the outer enclosure, wherein the liner is made from a tri-blend fabric including aluminum, a spunlaced synthetic fiber fabric and permanently flame-retardant rayon.

2. The enclosure of claim 1 wherein the inner liner is sized and shaped to closely conform to the outer liner, and the inner liner and outer enclosure are sized and shaped to closely receive the gas canister locker.

3. The enclosure of claim 2 wherein the outer enclosure is made from nylon of at least 1000 denier.

4. The enclosure of claim 3 wherein the lid is releasably sealed to the enclosure with a fire resistant hook and loop fastener.

5. An system for carrying oxygen canisters on an aircraft which comprises:

an openable locker for housing oxygen canisters;

an outer three dimensional fabric enclosure having a high temperature resistant sealable lid enclosing the locker; and an inner high temperature resistant metalized fabric liner fixed within the outer enclosure, wherein the liner is made from a tri-blend fabric including aluminum, a spunlaced synthetic fiber fabric and permanently flame-retardant rayon.

6. The enclosure of claim 5 wherein the inner liner is sized and shaped to closely conform to the outer liner, and the inner liner and outer enclosure are sized and shaped to closely receive the gas canister locker.

7. The enclosure of claim 6 wherein the outer enclosure is made from nylon of at least 1000 denier.

8. The enclosure of claim 7 wherein the lid is releasably sealed to the enclosure with a fire resistant hook and loop fastener.

* * * * *